US005419541A

United States Patent [19]

Stevens

[11] Patent Number: 5,419,541

[45] Date of Patent: May 30, 1995

[54] METHOD FOR SELECTIVELY BINDING PRE-PERSONALIZED INSERTS

[75] Inventor: Scott A. Stevens, Downers Grove, Ill.

[73] Assignee: Wallace Computer Services, Inc., Hillside, Ill.

[21] Appl. No.: 160,439

[22] Filed: Dec. 1, 1993

[51] Int. Cl.[6] ..... B65H 5/30; B65H 39/02

[52] U.S. Cl. ..... 270/57; 270/58

[58] Field of Search ..... 270/54, 58, 55, 57; 271/288; 209/583, 657

[56] References Cited

U.S. PATENT DOCUMENTS

| | | | |
|---|---|---|---|
| 3,656,738 | 4/1972 | Glaser et al. | 270/58 |
| 3,806,111 | 4/1974 | Lachman et al. | 270/54 |
| 3,816,866 | 6/1974 | Miaskoff et al. | 270/58 X |
| 3,899,252 | 8/1975 | Abram et al. | 270/54 |
| 3,917,252 | 11/1975 | Harder et al. | 270/58 |
| 3,953,017 | 4/1976 | Wise | 270/58 X |
| 4,022,455 | 5/1977 | Newsome et al. | 270/54 |
| 4,121,818 | 10/1978 | Riley et al. | 270/54 |
| 4,194,685 | 3/1980 | Hill et al. | 270/58 X |
| 4,384,196 | 5/1983 | MuCumber et al. | 270/58 X |
| 4,768,766 | 9/1988 | Berger et al. . | |
| 4,789,147 | 12/1988 | Berger et al. . | |
| 5,067,088 | 11/1991 | Schneiderhan | 270/58 X |
| 5,100,118 | 3/1992 | Hobbs et al. | 270/54 X |
| 5,114,128 | 5/1992 | Harris, Jr. et al. | 270/58 X |
| 5,143,362 | 9/1992 | Doane et al. . | |
| 5,280,895 | 1/1994 | Meier | 270/58 |
| 5,377,120 | 12/1994 | Humes et al. | 270/58 X |

FOREIGN PATENT DOCUMENTS 2012243 7/1979 United Kingdom .

*Primary Examiner*—John E. Ryznic

*Attorney, Agent, or Firm*—Tilton, Fallon, Lungmus & Chestnut

[57] ABSTRACT

A method for selectively binding pre-personalized inserts into book type publications such as magazines, newspapers, and catalogs as well as books themselves, the steps of providing batches of pre-personalized inserts and other inserts, providing a binding line equipped with a selective binding control system, providing a sequential feed for pre-personalized inserts to the binding line along with a diverter and introducer for other inserts into specific books.

10 Claims, 15 Drawing Sheets

FIG. 3

| CYCLE# | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| INSERTS COMMING UP CONVEYOR | 14 | 15 | | | | | | | | | | | | |
| | 13 | 14 | 15 | | | | | | | | | | | |
| | 12 | 13 | 14 | 15 | | | | | | | | | | |
| | 11 | 12 | 13 | 14 | 15 | | | | | | | | | |
| | 10 | 11 | 12 | 13 | 14 | 15 | | | | | | | | |
| SCAN | 9 | 10 | 11 | 12 | 13 | 14 | 15 | | | | | | | |
| DIVERTER-> | | | | DIVERT12 | | | | | | | | | | |
| SEPERATED INSERTS GOING TO POCKET | 8 | 9 | 10 | 11 | 11 | 13 | 14 | 15 | | | | | | |
| | 7 | 8 | 9 | 10 | 10 | 11 | 13 | 14 | 15 | | | | | |
| | 6 | 7 | 8 | 9 | 9 | 10 | 11 | 13 | 14 | 15 | | | | |
| | 5 | 6 | 7 | 8 | 8 | 9 | 10 | 11 | 13 | 14 | 15 | | | |
| | 4 | 5 | 6 | 7 | 7 | 8 | 9 | 10 | 11 | 13 | 14 | 15 | | |
| | 3 | 4 | 5 | 6 | 6 | 7 | 8 | 9 | 10 | 11 | 13 | 14 | 15 | |
| CHAIN-> | 3 | 4 | 5 | FLOOR | FLOOR | FLOOR | FLOOR | FLOOR | FLOOR | FLOOR | 13 | 14 | 15 | |
| | | | | GENERIC | GENERIC | GENERIC | GENERIC | GENERIC | GENERIC | GENERIC | | | | |
| #should be on chain | 3 | 4 | 5 | 6 | 7 | 8 | 9 | 10 | 11 | 12 | 13 | 14 | 15 | |
| RULE | | | | #2 | #4 | #4 | #4 | #4 | #4 | #4 | | | | |

FIG. 4

| CYCLE# | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| INSERTS COMMING UP CONVEYOR | 14 | 15 | | | | | | | | | | | | |
| | 13 | 14 | 15 | | | | | | | | | | | |
| | 12 | 13 | 14 | 15 | | | | | | | | | | |
| | 11 | 12 | 13 | 14 | 15 | | | | | | | | | |
| | 10 | 11 | 12 | 13 | 14 | 15 | | | | | | | | |
| SCAN | 9 | 10 | 11 | 13 | 13 | 14 | 15 | | | | | | | |
| DIVERTER-> | | | | DIVERT12 | | | | | | | | | | |
| SEPERATED INSERTS GOING TO POCKET | 8 | 9 | 10 | 11 | | | 15 | | | | | | | |
| | 7 | 8 | 9 | 10 | 11 | 13 | 14 | 15 | | | | | | |
| | 6 | 7 | 8 | 9 | 10 | 11 | 13 | 14 | 15 | | | | | |
| | 5 | 6 | 7 | 8 | 9 | 10 | 11 | 13 | 14 | 15 | | | | |
| | 4 | 5 | 6 | 7 | 8 | 9 | 10 | 11 | 13 | 14 | 15 | | | |
| | 3 | 4 | 5 | 6 | 7 | 8 | 9 | 10 | 11 | 13 | 14 | 15 | | |
| CHAIN-> | 3 | 4 | 5 | 6 | 7 | 8 | 9 | 10 | 11 | 13 | 14 | 15 | | |
| | | | | | | | | | | | | | | |
| #should be on chain | 3 | 4 | 5 | 6 | 7 | 8 | 9 | 10 | 11 | 13 | 14 | 15 | 16 | |
| RULE | | | | | | | | | | #6 | | | | |

FIG. 5

| CYCLE# | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| INSERTS COMMING UP CONVEYOR | 14 | 15 | | | | | | | | | | | | |
| | 13 | 14 | 15 | | | | | | | | | | | |
| | 12 | 13 | 14 | 15 | | | | | | | | | | |
| | 11 | 12 | 13 | 14 | 15 | | | | | | | | | |
| | 10 | 11 | 12 | 13 | 14 | 15 | | | | | | | | |
| SCAN | 9 | 10 | 11 | 12 | 13 | 14 | 15 | | | | | | | |
| DIVERTER-> | | | | | | | | | | | | | | |
| SEPERATED INSERTS GOING TO POCKET | 8 | 9 | 10 | 11 | 12 | 13 | 14 | 14 | 15 | | | | | |
| | 7 | 8 | 9 | 10 | 11 | 12 | 13 | 13 | 14 | 15 | | | | |
| | 6 | 7 | 8 | 9 | 10 | 11 | 12 | 12 | 13 | 14 | 15 | | | |
| | 5 | 6 | 7 | 8 | 9 | 10 | 11 | 11 | 12 | 13 | 14 | 15 | | |
| | 4 | 5 | 6 | 7 | 8 | 9 | 10 | 10 | 11 | 12 | 13 | 14 | 15 | |
| | 3 | 4 | 5 | 6 | 7 | 8 | 9 | 9 | 10 | 11 | 12 | 13 | 14 | 15 |
| CHAIN-> | 3 | 4 | 5 | 6 | 7 | 8 | INHIBIT | 9 | 10 | 11 | 12 | 13 | 14 | 15 |
| | | | | | | | GENERIC | | | | | | | |
| #should be on chain | 3 | 4 | 5 | 6 | 7 | 8 | 8A | 9 | 10 | 11 | 12 | 13 | 14 | 15 |
| RULE | | | | | | | #7 | | | | | | | |

FIG. 6

| CYCLE# | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| INSERTS COMMING UP CONVEYOR | 12 | 13 | | | | | | | | | | | | |
| | 12 | 12 | 13 | 14 | 15 | | | | | | | | | |
| | 12 | 12 | 12 | 13 | 14 | 15 | | | | | | | | |
| | 11 | 12 | 12 | 12 | 13 | 14 | 15 | | | | | | | |
| | 10 | 11 | 12 | 12 | 12 | 13 | 14 | 15 | | | | | | |
| SCAN | 9 | 10 | 11 | 12 | 12 | 12 | 13 | 14 | 15 | | | | | |
| DIVERTER-> | | | | | DIVERT12 | DIVERT12 | | | | | | | | |
| SEPERATED INSERTS GOING TO POCKET | 8 | 9 | 10 | 11 | 12 | | | | | | | | | |
| | 7 | 8 | 9 | 10 | 11 | 12 | | | | | | | | |
| | 6 | 7 | 8 | 9 | 10 | 11 | 12 | 13 | 14 | 15 | | | | |
| | 5 | 6 | 7 | 8 | 9 | 10 | 11 | 12 | 13 | 14 | 15 | | | |
| | 4 | 5 | 6 | 7 | 8 | 9 | 10 | 11 | 12 | 13 | 14 | 15 | | |
| | 3 | 4 | 5 | 6 | 7 | 8 | 9 | 10 | 11 | 12 | 13 | 14 | 15 | |
| CHAIN-> | 3 | 4 | 5 | 6 | 7 | 8 | 9 | 10 | 11 | 12 | 13 | 14 | 15 | |
| | | | | | | | | | | | | | | |
| #should be on chain | 3 | 4 | 5 | 6 | 7 | 8 | 9 | 10 | 11 | 12 | 13 | 14 | 15 | |
| RULE | | | | | #1 | #1 | | | | | | | | |

FIG. 7

| CYCLE# | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| INSERTS COMMING UP CONVEYOR | 15 | | | | | | | | | | | | | |
| | 14 | 15 | | | | | | | | | | | | |
| | 13 | 14 | 15 | | | | | | | | | | | |
| | 12 | 13 | 14 | 15 | | | | | | | | | | |
| | 10 | 12 | 13 | 14 | 15 | | | | | | | | | |
| SCAN | 9 | 10 | 12 | 13 | 14 | 15 | | | | | | | | |
| DIVERTER-> | | | | | | | | | | | | | | |
| SEPERATED INSERTS GOING TO POCKET | 8 | 9 | 10 | 12 | 13 | 14 | 15 | | | | | | | |
| | 7 | 8 | 9 | 10 | 12 | 13 | 14 | 15 | | | | | | |
| | 6 | 7 | 8 | 9 | 10 | 12 | 13 | 14 | 15 | 15 | | | | |
| | 5 | 6 | 7 | 8 | 9 | 10 | 12 | 13 | 14 | 14 | 15 | | | |
| | 4 | 5 | 6 | 7 | 8 | 9 | 10 | 12 | 13 | 13 | 14 | 15 | | |
| | 3 | 4 | 5 | 6 | 7 | 8 | 9 | 10 | 12 | 12 | 13 | 14 | 15 | |
| CHAIN-> | 3 | 4 | 5 | 6 | 7 | 8 | 9 | 10 | INHIBIT | 12 | 13 | 14 | 15 | |
| | | | | | | | | | GENERIC | | | | | |
| #should be on chain | 3 | 4 | 5 | 6 | 7 | 8 | 9 | 10 | 11 | 12 | 13 | 14 | 15 | |
| RULE | | | | | | | | | #3 | | | | | |

FIG. 8

| CYCLE# | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| INSERTS COMMING UP CONVEYOR | 14 | 15 | | | | | | | | | | | | |
| | 13 | 14 | 15 | | | | | | | | | | | |
| | 12 | 13 | 14 | 15 | | | | | | | | | | |
| | 11 | 12 | 13 | 14 | 15 | | | | | | | | | |
| | 10 | 11 | 12 | 13 | 14 | 15 | | | | | | | | |
| SCAN | 9 | 10 | 12 | 13 | 14 | 15 | | | | | | | | |
| DIVERTER-> | | | | | | | | | | | | | | |
| SEPERATED INSERTS GOING TO POCKET | 8 | X9 REMOVE | 10 | 11 | 12 | 13 | 14 | 15 | | | | | | |
| | 7 | X8 REMOVE | | 10 | 11 | 12 | 13 | 14 | 15 | | | | | |
| | 6 | X7 REMOVE | | | 10 | 11 | 12 | 13 | 14 | 15 | | | | |
| | 5 | X6 REMOVE | | | | 10 | 11 | 12 | 13 | 14 | 15 | | | |
| | 4 | X5 REMOVE | | | | | 10 | 11 | 12 | 13 | 14 | 15 | | |
| | 3 | X4 REMOVE | | | | | | 10 | 11 | 12 | 13 | 14 | 15 | |
| CHAIN-> | 3 | JAM | INHIBIT | INHIBIT | INHIBIT | INHIBIT | INHIBIT | 10 | 11 | 12 | 13 | 14 | 15 | |
| | | | GENERIC | GENERIC | GENERIC | GENERIC | GENERIC | | | | | | | |
| #should be on chain | 3 | 4 | 5 | 6 | 7 | 8 | 9 | 10 | 11 | 12 | 13 | 14 | 15 | |
| RULE | | | | | | | | | | | | | | |

FIG. 9

| CYCLE# | 1 | 2 | 3 | 4 | 5 | 6 | 7 | 8 | 9 | 10 | 11 | 12 | 13 | 14 |
|---|---|---|---|---|---|---|---|---|---|---|---|---|---|---|
| INSERTS COMMING UP CONVEYOR | 14 | 15 | | | | | | | | | | | | |
| | 13 | 14 | 15 | | | | | | | | | | | |
| | 12 | 13 | 14 | | | | | | | | | | | |
| | 11 | 12 | 13 | 15 | | | | | | | | | | |
| | 10 | 11 | 12 | 14 | 15 | 15 | | | | | | | | |
| SCAN | 9 | 10 | 11 | 13 | 14 | 14 | 15 | | | | | | | |
| DIVERTER-> | | | | | | | | | | | | | | |
| SEPERATED INSERTS GOING TO POCKET | 8 | 9 | 10 | 12 | 13 | 13 | 14 | 15 | | | | | | |
| | 7 | 8 | 9 | 11 | 12 | 12 | 13 | 14 | 15 | | | | | |
| | 6 | 7 | 8 | 10 | 11 | 11 | 12 | 13 | 14 | 15 | | | | |
| | 5 | 6 | 7 | 9 | 10 | 10 | 11 | 12 | 13 | 14 | 15 | | | |
| | 4 | 5 | 6 | 8 | 9 | 9 | 10 | 11 | 12 | 13 | 14 | 15 | | |
| | 3 | 4 | 5 | 6&7 | 8 | 8 | 9 | 10 | 11 | 12 | 13 | 14 | 15 | |
| CHAIN-> | 3 | 4 | 5 | 7(6 ON FLOOR) | INHIBIT | 8 | 9 | 10 | 11 | 12 | 13 | 14 | 15 | |
| | | | | REJECT BOOK | GENERIC | | | | | | | | | |
| #should be on chain | 3 | 4 | 5 | 6 | 7 | 8 | 9 | 10 | 11 | 12 | 13 | 14 | 15 | |
| RULE | | | | | #3 | | | | | | | | | |

METHOD FOR SELECTIVELY BINDING PRE-PERSONALIZED INSERTS

BACKGROUND AND SUMMARY OF INVENTION

This invention relates to a method for selectively binding pre-personalized inserts and, more particularly, to such inserts as signatures, mailers, cards and the like.

It has become very popular to be able to create several different versions of a book (i.e., magazine, newspaper, catalog, book itself, etc.) at the same time, to save on postal charges and to direct advertising at specific individuals. For instance, a clothing store may want to provide different catalogs based on the customer's gender. In conventional binding, each type of catalog would have to be bound on separate bindery lines, thus creating two mailings. In the inventive selective binding, both catalogs are created at the same time on the same bindery line. The men's clothing and women's clothing pages are loaded into separate feeders on the bindery line. A control computer examines each recipient for gender and directs the bindery line to actuate the proper feeders to create the desired catalog. This is known as selective binding.

To date, the only type of personalization of selectively bound books has been ink jet printing at the time the book is bound. Ink jet printing is limited in print quality, number of lines of variable data that can be printed on a page, lack of ability to print graphics, and the ability to print on interior plies of a sealed insert. Patents such as U.S. Pat. Nos. 4,789,149 and 4,768,766 and 4,121,818 and 3,917,252 and 3,899,165 disclose selective binding systems that include ink jet personalization. Pre-personalization (i.e., off-line personalization) on the other hand allows for personalized information on both sides of a sheet covering the entire sheet. It also provides the possibility to personalize interior plies of sealed mailer type constructions, and very high print quality.

Previous attempts at including pre-personalized signatures in books, such as U.S. Pat. Nos. 5,143,362 and 5,114,128 were limited in that these methods did not allow for the selective binding of the pre-personalized signature itself. In these patents all recipients would receive a pre-personalized signature. According to the present method, pre-personalized signatures would be able to be selectively bound in a book. Based on preselected demographics, only selected recipients would receive a pre-personalized insert. This enables advertisers to direct these special inserts at a specific group of individuals.

In the '362 and '128 patents the pre-personalized signature controls the bindery line. Each signature's indicia is read, and based on what was read, the bindery line reacts. In the present method the standard selective binding control computer and database control the bindery line. The bindery control computer requests a specific insert, and it is up to the feeder to ensure that the requested insert is placed on the bindery chain. The above mentioned patents are limited to inserting pre-personalized "signatures" only. They define a "signature" as having its normal meaning in the book publishing field which is a large page of paper folded to form 2, 4, 8, . . . pages of a book or magazine. The current method applies to all forms of inserts such as signatures, blown in cards, sealed multi-ply constructs, bound in cards, or other wraps.

More particularly, the invention includes a method for providing the selective insertion of pre-personalized inserts and signatures into magazines, newspapers, catalogs, and like "book" publications. A book is made up of a number of signatures bound either by perfect binding or saddle stitching. The book is then wrapped in a cover and addressed using labels or printed on the cover, utilizing some type of electronic printing device. The address information is delivered from a bindery line control computer's database to the addressing station on the bindery line. The selective insertion of pre-personalized inserts or signatures to match the address information on the cover of the book is accomplished by detecting an indicia on the pre-personalized insert and comparing it to the address information sent by the bindery line control computer. An insert feeder is provided that enables the rejection of selective inserts before they are able to reach the book gathering point. This way when the insert and data from the control computer do not match, the mismatching insert can be diverted away from the bindery line. The feeder operates asynchronously to the bindery line to enable the feeder to self synchronize with the bindery line even if the bindery line is stopped. The asynchronous nature of the feeder also provides a means for the feeder to "catch up" with the bindery line in the case of diverted inserts. The speedup of the feeder allows the feeder to fill the void from a diverted insert.

Other objects and advantages of the invention can be seen in the ensuing specification.

BRIEF DESCRIPTION OF DRAWING

The invention is described in conjunction with the accompanying drawing, in which

FIG. 3 is a chart showing the distribution of numbered inserts when a mis-feed occurs;

FIG. 4 is another chart of insert distribution in the system reflecting the situation where records are deleted that inserts were produced for;

FIG. 5 is a chart showing the distribution of inserts when records are added that require an insert;

FIG. 6 is a chart showing the distribution of inserts when duplicate inserts enter the system;

FIG. 7 is a chart showing the distribution of inserts when the system is missing inserts;

FIG. 8 is a chart showing the distribution of inserts in the system where a pocket jam is encountered; and FIG. 9 is a chart showing the distribution of inserts in the system where the situation involves a double feed;

DETAILED DESCRIPTION

Figure 1:
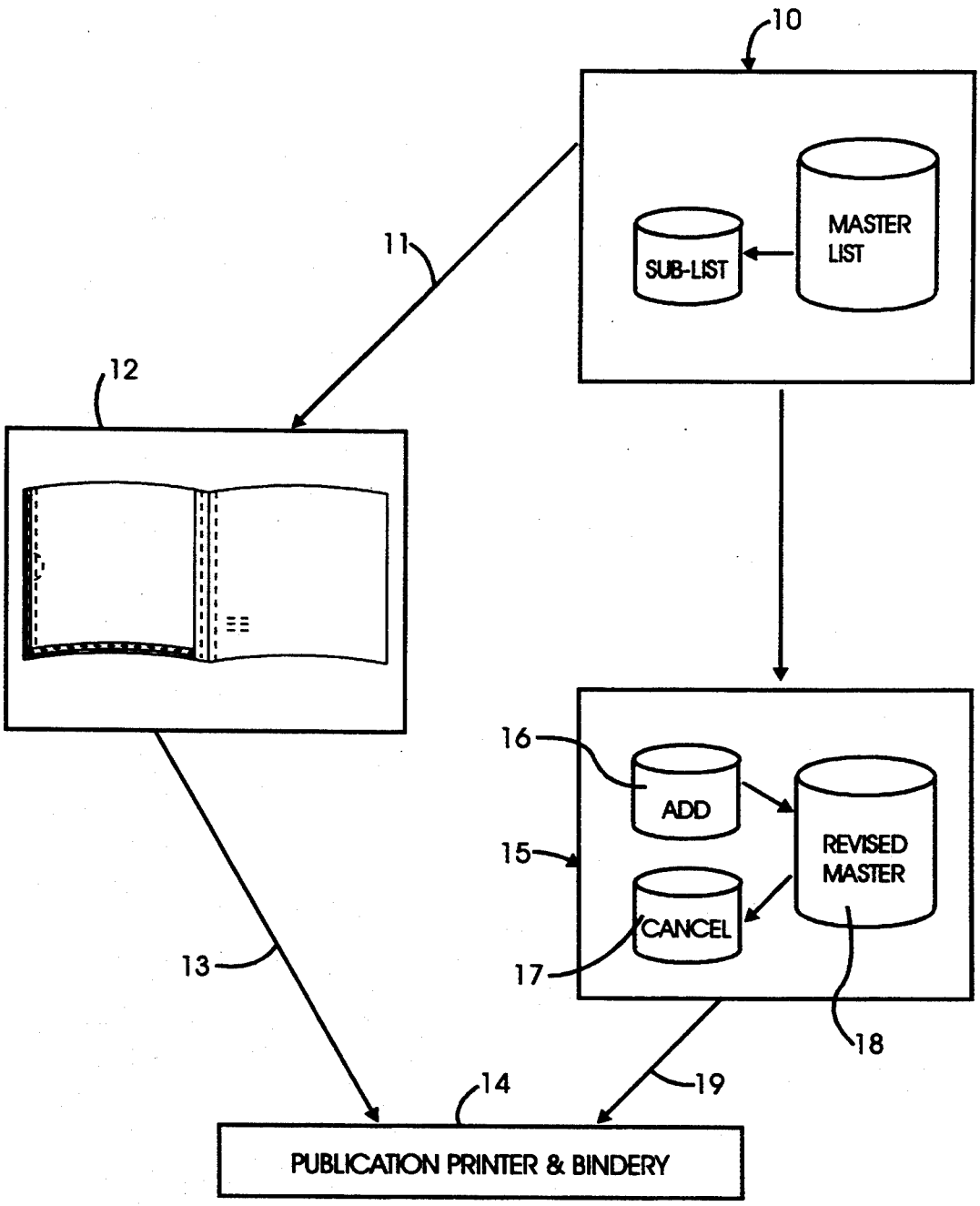
FIG. 1 is a schematic flow diagram of information relating to pre-personalized inserts.

Referring first to FIG. 1, the numeral 10 designates a list processing center which develops a list of names and addresses for the selective binding and mailing. This starts with the MASTER LIST which is to be employed in connection with book publication. The MASTER LIST is sorted and sequence numbers added to insert publication records before a SUB LIST is pulled for insert production.

This SUB LIST is sent as at 11 to the insert producer 12 where inserts are produced with the sequence numbers suitably applied for subsequent sensing. An advantage is to encode the sequence numbers in a bar code (also eye readable) across the outer spine of the insert. Thereafter the inserts are "bricked", i e suitably packaged and tie wrapped for shipment as at 13 to the PUBLICATION PRINTER AND BINDERY 14.

During the time the insert producer 12 is producing the inserts, many changes usually take place in the MASTER LIST. This is illustrated at 15 where, if the book is a magazine, new subscribers may be added as at ADD 16 and others canceled as at CANCEL 17. During this change the records with the added sequence numbers stay in original order. The revised master REV MASTER 18 is then delivered to the printer/bindery 14 as at 19.

Figure 2:
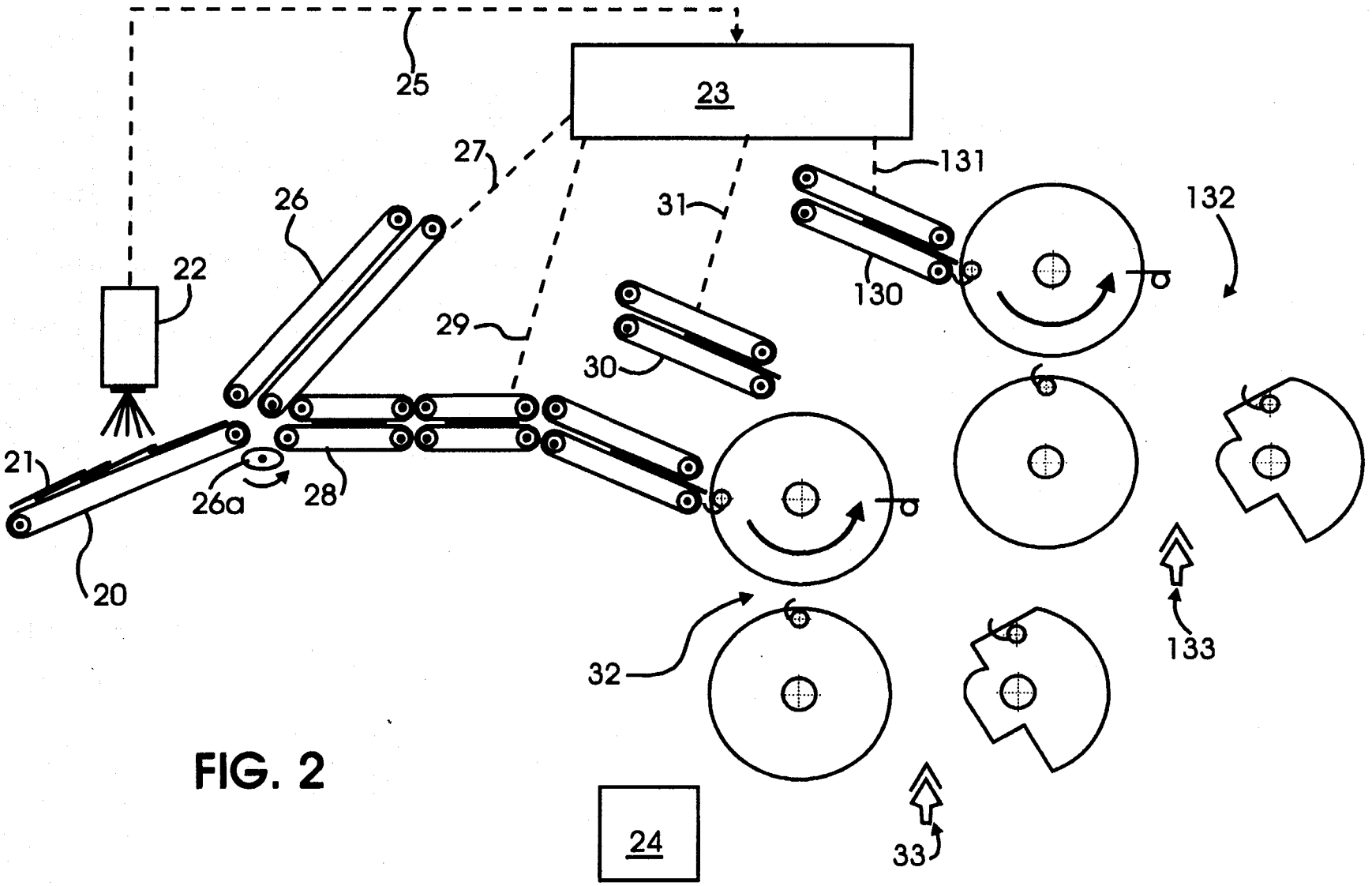
FIG. 2 is a side elevational view, somewhat schematic of the binding operation and structure.

At the printer/bindery 19, the operation depicted in FIG. 2 takes place. In general, two pockets are set up for the inserts, one for personalized and the second for other inserts such as those for the opposite gender or "generic" i.e., non-personalized inserts. A pocket is the part of a saddle stitch binding line which opens up a signature or insert and places it on the book being created on the saddle or chain. An ink jet printer is optimally provided for the generic pocket.

In FIG. 2, the numeral 20 designates a shingling feed conveyor for inserts 21. Prior to being placed on the conveyor 20, bricks delivered as at 13 and containing a plurality of inserts, are hand laser scanned to ensure proper loading order. And while on conveyor 20, the inserts 21 are subjected to sensing as at 22 to "read" the bar code. The sensed information is delivered to an insert controller 23 which is coupled to the bindery line controller 24. The controller 24 has as its data base, the list delivered at 19. The insert controller 23 is coupled to the sensor 22 via line 25 to divert conveyor 26 via divert cam 26*a* and line 27, to the buffer 28 via line 29 and to generic insert supply and feed means 30 via line 31. Both the buffer 28 and feed means 30 feed directly into the pocket drum grippers 32 provided on the binding lines. Here, the binding line is of the saddle stitch type as represented by the saddle or chain 33. However, the invention has equal application to perfect binding where the inserts and other signatures stand on end. Alternatively, a separate pocket 132 can be provided for the generic insert supply 130 actuated by line 131 for deposit on saddle or chain 133.

Essentially, the invention provides a delivery system for a conventional bindery line which takes care of two problem variations: (1) an update in the MASTER LIST via addition/cancellation which then does not correspond to the sequence of inserts delivered at 13, and (2) misoperation of the bindery line and associated equipment. These departures from scheduled feeding are:

Missing inserts
Duplicate insert
Duplicated series inserts
Added records that need an insert
Records deleted that inserts were produced for
Bindery misfeeds
Bindery double feeds
Bindery jams
Bindery synchronization
Small out-of-ordering problems in the insert sequence.

The apparatus which is capable of coping with these departures from scheduled feeding includes a binding line represented by the saddle or chain 33 and which has the selective binding control system 24 equipped with a production data base 18 delivered via 19 to the printer/bindery 14. In a general sense, the apparatus includes means for sequentially feeding personalized inserts from each brick to the binding line and this can be considered to include both the shingling feed conveyor 20 and the buffer conveying means 28. In the illustrated embodiment, these are separate in order to advantageously interpose the means for diverting the unwanted inserts via the divert conveyor 26 by activating divert cam 26*a*. Also associated with the feeding means 20, 28 are means for inhibiting the same which can be suitable servo motors controlled by the insert controller 23. In the same fashion, the master controller provides a signal for means for removing inserts from the feeding means and for introducing generic inserts into the binding lines 33, 133.

The solution to these problem situations is provided by programming the insert controller 23 according to the following rules:

1. If the currently sensed insert is an equal or lower numbered insert than the previously sensed insert, divert it to the divert conveyor 26.
2. If a misfeed occurs, divert one insert.
3. If the next inert to feed from 20 has a higher number than that requested by the binder line control system, inhibit the insert feed conveyor 20.
4. If the next insert to feed has a smaller number than that requested by the binder line control system, cull the insert.
5. If the personalized feed is inhibited, feed a generic insert from the means 30.
6. If the sensed insert is a lower numbered insert than that requested by the binder line control system, divert the insert.
7. If the number for an insert requested by the bindery line control system contains an alpha character, inhibit the feed.

Further, Rule #4 relating to culling contemplates two variations. If the cull step includes dropping the insert on the floor, feed a generic insert. If the cull step includes feeding the lower numbered insert into a book, remove the book at the end of the binder line.

FIGS. 3–9 illustrate the application of the foregoing rules. In FIGS. 3–9, each column labeled 1–14 is called a cycle. A cycle is a movement or step of the bindery line where the book being created collects another signature or insert. The rows labeled by "inserts coming up conveyor" represent the order of the pre-personalized inserts 21 as they approach the barcode reader 22 on conveyor 20. The row labeled "SCAN" represents what the barcode reader 22 reads from the pre-personalized insert 21 directly underneath it. The row labeled "DIVERTER" represents a pre-personalized insert that has been diverted by the actuation of diverter cam 26a and is seen on conveyor 26. The rows labeled "separated inserts going to pocket" represent the order of pre-personalized inserts 21 in the buffer 28. The row labeled "CHAIN" represents the pre-personalized insert 21 that is placed on the book that is being created at the saddle or chain 33. The row labeled "# should be on chain" represents the number of the book that is being created on the saddle or chain 33. To ensure that the pre-personalized insert matches the addressed recipient of the book, the numbers from the row labeled "CHAIN" and the row labeled "# should be on the chain" should be the same. Finally, the row labeled "RULE" represents the rule that applies to the particular situation.

For example, FIG. 3 illustrates Rules 2 and 4 the distribution of inserts when a mis-feed occurs. In such a case, the number of inserts lost will be equal to the number in the buffer 28 at the time of the mis-feed plus the mis-feed itself.

FIG. 4 illustrates the application of Rule 6 when records are deleted that call for inserts that were produced. In such a situation, the sensing scanner 22 compares the number on the insert to the number that should go into the matching book, i.e., the current book being created plus the number of inserts in the buffer 28. If the number on the scanned insert is lower than the targeted book, then the insert is diverted. Because the program calls for the feeder to run at two times the maximum speed of the line, if there are enough deleted records in a row, the buffer will empty out causing generics to be fed and a warning to the operator to slow down so as to allow the feeder to catch up with the system.

FIG. 5 illustrates the application of Rule 7 where records are added that require an insert. All of the inserts produced as at 12 advantageously will contain all digits. Therefore, added records to be distinguishable may contain an alpha character and this will signal the system that it is an added record and requires a generic insert.

FIG. 6 illustrates the situation where there are duplicate inserts and the application under Rule #1. All duplicate series of numbers are taken care of under Rule #1 on the first insert of the series and then Rule #6 for the rest of the series.

FIG. 7 illustrates the situation where there are missing inserts and the application of Rule #3.

FIG. 8 illustrates the situation where there is a pocket jam and this is not covered by the rules inasmuch as it requires the operator to clear out all of the inserts between the chain and the scanner. After doing this, the operator hits the start button for recommencing operation of the line.

FIG. 9 illustrates the double feed situation and reflects the application of Rule #3. The double feed triggers a sensor which causes the inhibit conveyor to operate and results in a generic feed for the next slot. A sensor is normally part of the bindery line control computer system 24 and is used herein by the controller 23.

Figure 10:
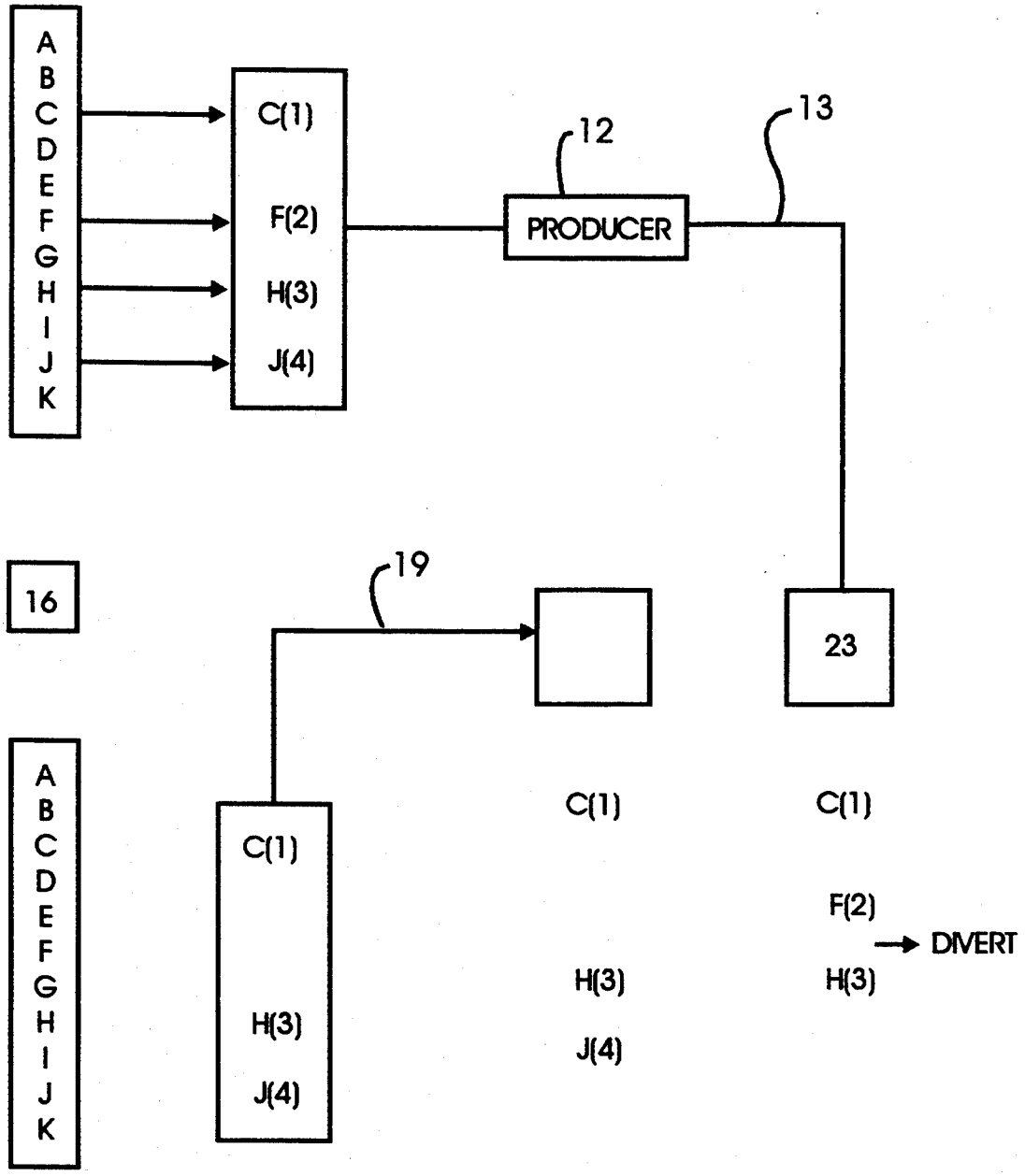
FIG. 10 is a chart showing the operation of deletion of a name from the master list and how it operates in accordance with the arrangement of FIG. 1.

For a simplified example of the foregoing charts, reference is made to FIG. 10. At the upper left, the master list is seen to include names A–K of which C, F, H and J are assigned a sequence number (as at 1–4) and transmitted to the insert producer 12—where pre-personalized inserts are prepared and transmitted to the printer/bindery 14 via 13. In the interim, the master list has been altered at 15 by deleting F as can be seen at the lower left and this altered list is transmitted via 19 to the printer binder 14.

At the printer/binding 14, there are the two controllers 23, 24. The printer/bindery master controller 24 now requests the pre-personalized insert controller 23 to provide pre-personalized inserts for C, H and J. So when the insert for F enters the feeder, there is no call for it and, because it is lower than the next insert H also being sensed by the controller 23, the insert for F is diverted.

The inventive system, i.e., FIG. 2, is substantially non-intrusive. In other words, it will require no software changes to the existing bindery line control system, and no permanent modifications to mechanics or electronics of the bindery line.

The invention provides a delivery system having the following characteristics:

Asynchronous movement to the Bindery line. The delivery of inserts to the pocket must be able to run independently of the bindery line. Even when the line is stopped, the feeder can still run, filling the buffer 28 and diverting inserts to conveyor 26.

Speed of delivery must exceed the maximum speed of the bindery line. Two times faster is especially advantageous.

Inserts must be separated for scanning. The inserts may be completely separated or more preferably be shingled at 1" overlap. If they are shingled, they will be moving slower past the scanner resulting in higher read rates. Currently, scanners cannot scan barcodes moving faster than 250 fpm.

Insert divert path 26—it is advantageous to divert inserts very soon after scanning, preferably within one insert after scanning.

About three inserts are advantageously placed in the buffer 28 between the divert conveyor 26 and the pocket 32. The buffer 28 thereby performs a "catch-up" function. If one insert is in the buffer, waiting at the pocket, the buffer allows the two other slots to be filled while the one sits waiting for the pocket to feed it.

In the usual bindery line, there is easy access to clean out inserts between the pocket and the scanner. In jam conditions, this area may be cleaned out by the operator. The delivery system operates advantageously with conventional selective bindery line control systems, viz., AM Graphics, Scitex, Video Jet, Prism, etc.

In the method, the following steps are performed to develop the revised master list 18.

(a) Demographically select the records for insert production;

(b) Before pulling those records, postal sort the master file;

(c) Add an 8-digit sequence number to the selected records; and (d) Pull a copy of the records for the insert producer.

The master file can have records that are targeted for inserts deleted or added. To target a new record for the insert, add the 8 character sequence field previously established to the record and place an "A" as the first character of the field.

At the time of the bindery production, re-postal sort the master file for best postal discount. The records pulled for the insert producer should still be very close to the original sequence.

A second sort may be necessary after the postal sort to achieve the best possible ordering of the insert records. Records that are out of order will get a generic insert, and the personalized one that was produced at the insert producer will be scrapped.

Software for Controller 23

Figure 11:
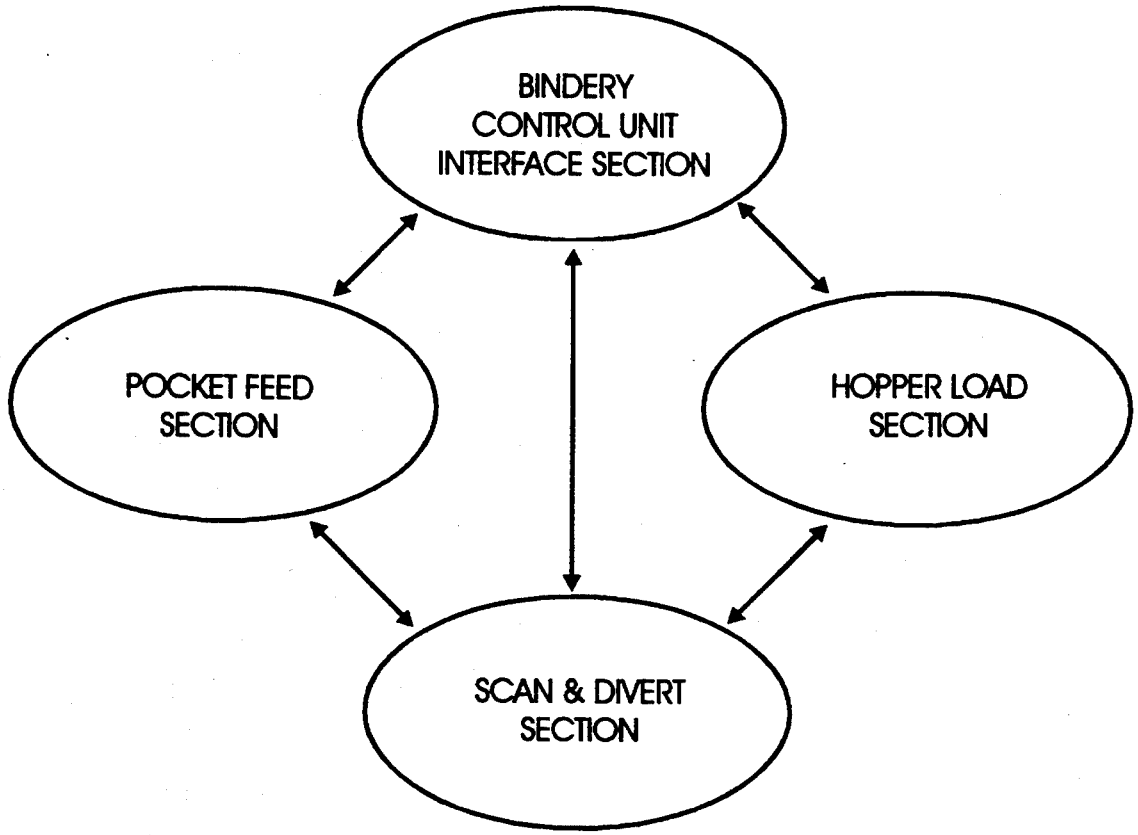
FIG. 11 is a flow chart showing the relationship between the four independent processes controlling the insert feeder system.

Reference is now made to FIG. 11 which has to do with the selectively bound, pre-personalized insert system. To be able to selectively bind the pre-personalized inserts into books and the like, a system advantageously contains the four functions depicted in FIG. 11. A bindery control unit interface section to enable the insert feeder to communicate to the bindery control unit; a hopper load section to assist and ensure that the proper packs/bricks of pre-personalized inserts are loaded on the feeder in the proper order; a scan and divert section to identify the pre-personalized inserts and decide whether to pass the insert on to the bindery line or divert it to scrap; and finally a pocket feed section that makes a final comparison of the next insert to feed to the book being assembled.

Figure 12:
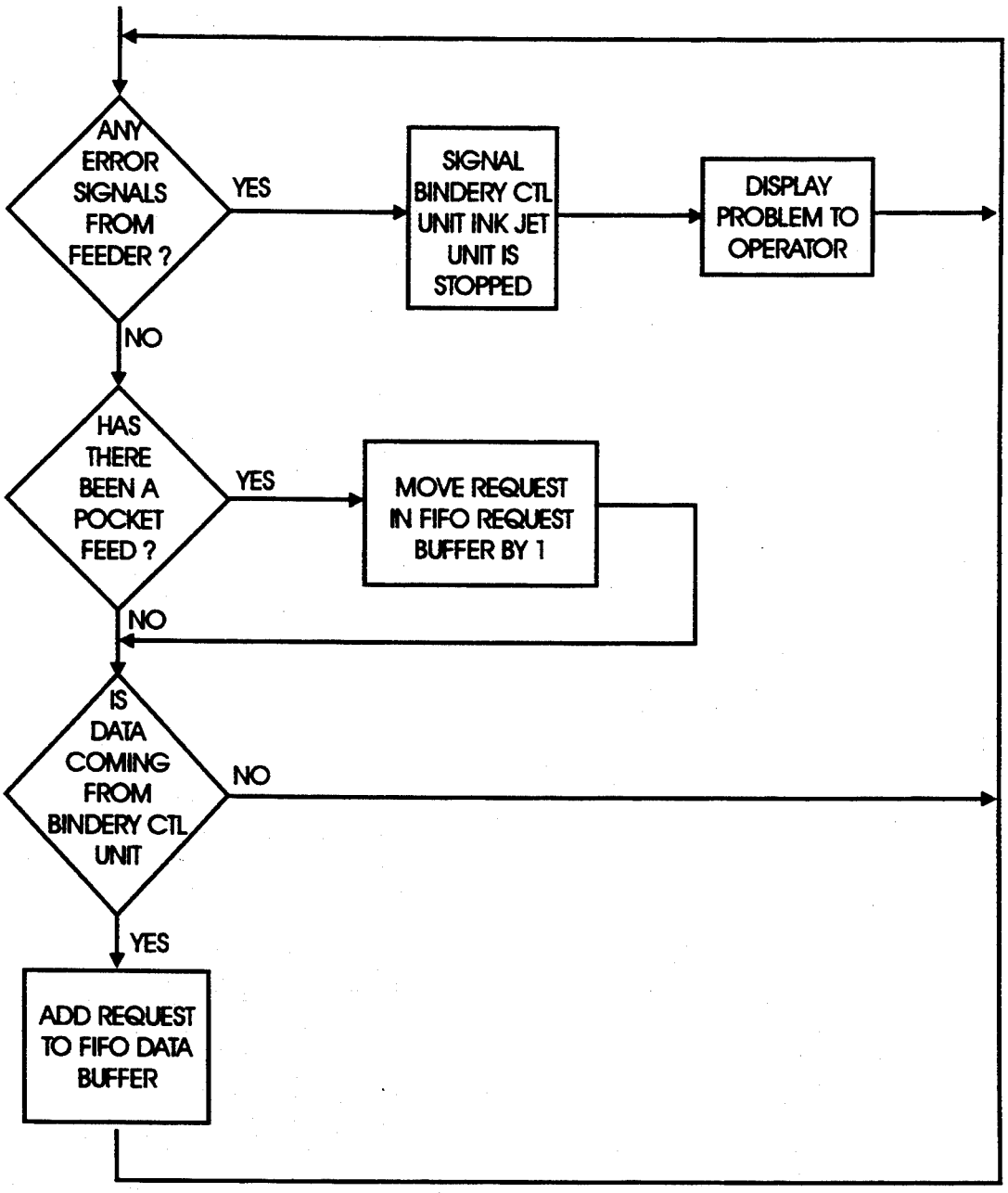
FIG. 12 is a flow chart dealing with a portion of FIG. 11 and is a detailed flow diagram of the bindery control unit interface section of the insert feeder system.

The bindery control unit interface in FIG. 12 enables the bindery line selective binding control computer to communicate to the pre-personalized insert feeder system. This communication is in the form of ink jet printer data and advantageously consists of a sequence number that is added to the data base at the time the personalized inserts are created. The interface section may also communicate back to the bindery line selective binding control computer 24 with error signals in the form of ink jet printer error signals. The communication is based on ink jet printer data because that type of communication is already known by the bindery line computer and allows the insert feeder to operate without alteration to the bindery line computer's software or hardware. The section of FIG. 12 collects sequence numbers from the bindery line control computer and stores those sequence numbers in a FIFO (first in first out) type electronic buffer means. This buffer means is made available to the other sections of the insert feeder system for interrogation. This section also monitors errors in the insert feeder system. If an error occurs, this section notifies the bindery control computer via an ink jet error that the bindery line must stop and attention must be given to the insert feeder system.

Figure 13:
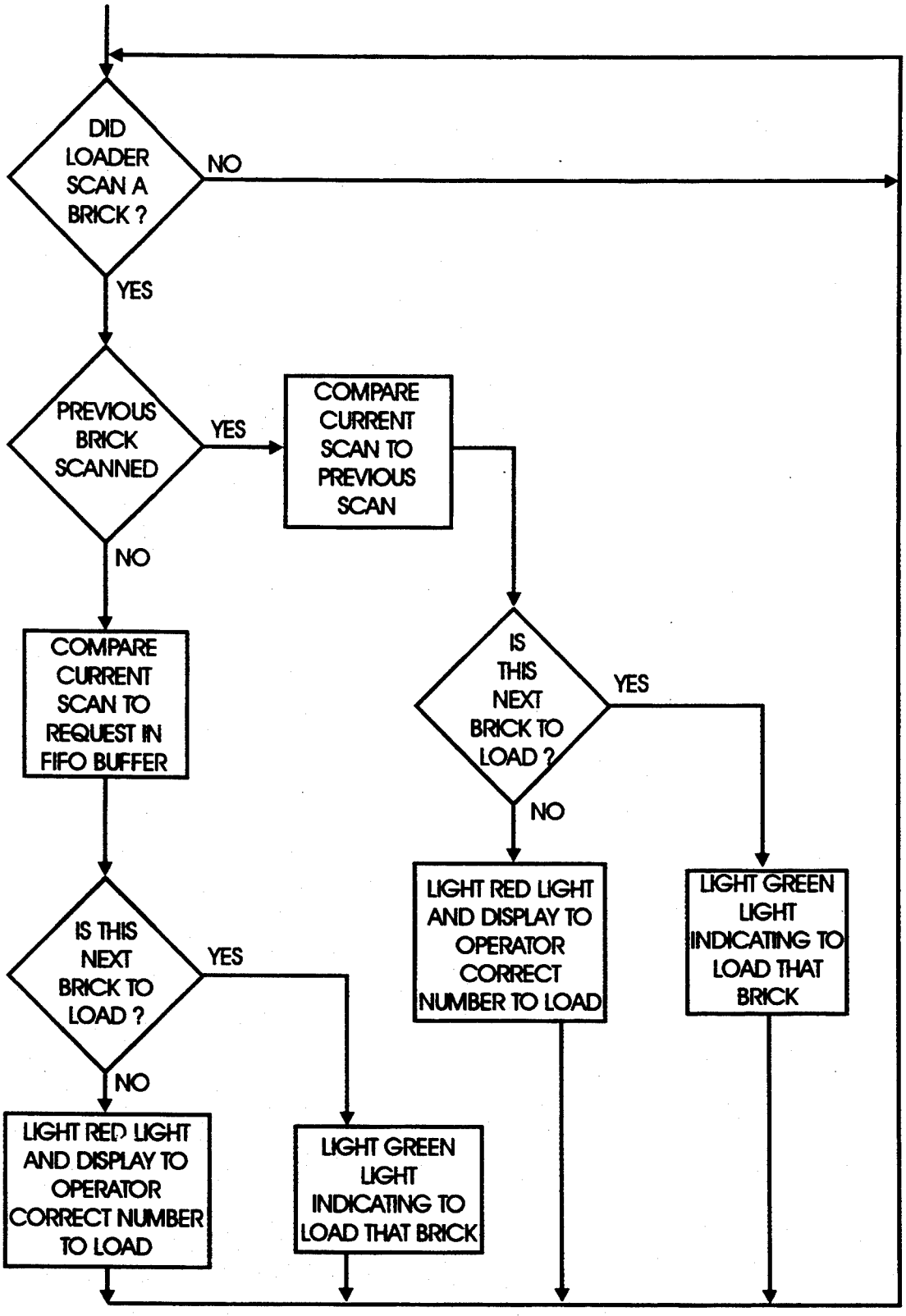
FIG. 13 is another flow chart dealing with another portion of FIG. 11 and is a detailed flow diagram of the hopper loader section of the insert feeder system.

FIG. 13 is the flow diagram of how the insert feeder assists the loading of pre-personalized inserts into the insert feeder. This is usually a manual process and, without computer assistance, would be a high risk area for mistakes. The person loading bundles/bricks of pre-personalized inserts must load them in exactly the correct order. If a brick of inserts is loaded out of the proper order, the insert feeder would be forced to discard all the inserts in that brick or stop the bindery line and inform the operator on a severe out-of-sequence problem. The flow diagram of FIG. 13 depicts how the insert feeder guides the person loading the insert feeder to load the proper bundle/brick. When a new brick is required to be loaded into the insert feeder, the person loading the feeder scans the label on, what the loader feels is the next brick to load. The scanned data contains the sequence numbers included in that brick. These numbers are compared to what the bindery line control interface has in it's sequence buffer means and informs the person loading the brick if it is the correct brick to load or not. If it is not the correct brick, the correct number to load is displayed to the loader to assist him/her.

Figure 14:
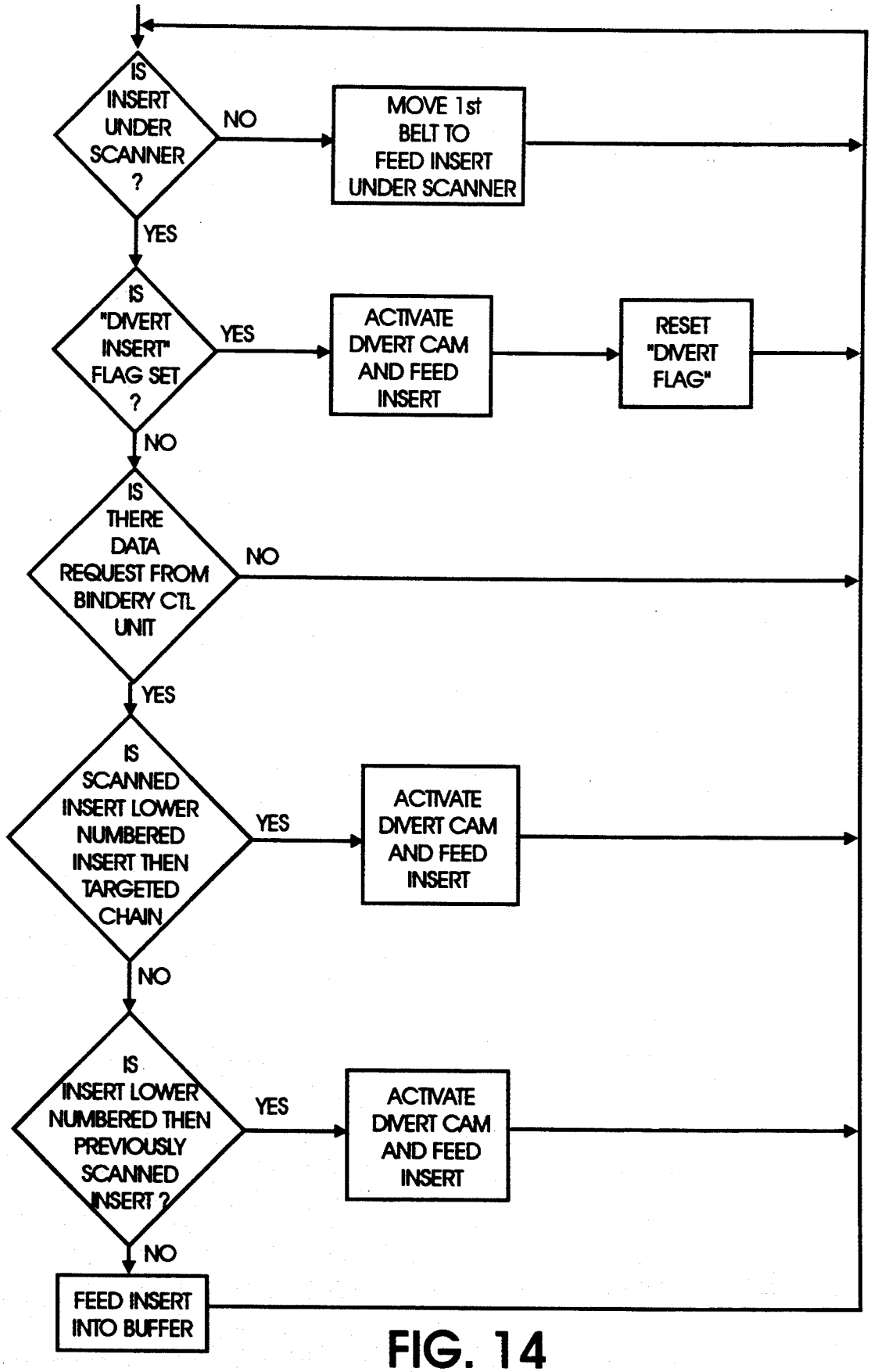
FIG. 14 is still another flow chart dealing with still another portion of FIG. 11 and is a detailed flow diagram of the scan and divert section of the insert feeder system.

The scan and divert section FIG. 14 depicts the steps taken when the pre-personalized inserts are scanned and a decision has to be made whether to keep the insert and pass it on to be fed into the pocket or divert the insert so as to be scrapped. This section controls the feeding of pre-personalized inserts under the scanner and also a diverting means to send scanner-rejected scanned pre-personalized inserts to a scrap bin. This section has access to an indicator in the pocket feed section FIG. 15 which may request an insert to be diverted. This section also has access to the sequence number request buffer means from the bindery line control interface section of FIG. 12. As the section of FIG. 14 scans and feeds inserts to the pocket feed section FIG. 15, the sequence numbers from the fed inserts are stored in another FIFO type buffer means as in the bindery line control interface section FIG. 12. As pre-personalized inserts are scanned they are first compared to the previously scanned insert. If the newly scanned insert is a lower numbered insert than the previously scanned insert it is diverted away from the insert feeder. The scanned inserts are then compared to the sequence number request buffer means from the bindery line control interface section FIG. 12. If the scanned sequence number from the insert is a lower number than the requested number in the bindery line control interface section's buffer means, the insert is diverted away from the feeder if the number is equal or higher than the requested number, the insert is fed into the pocket feed section shown in FIG. 15.

Figure 15:
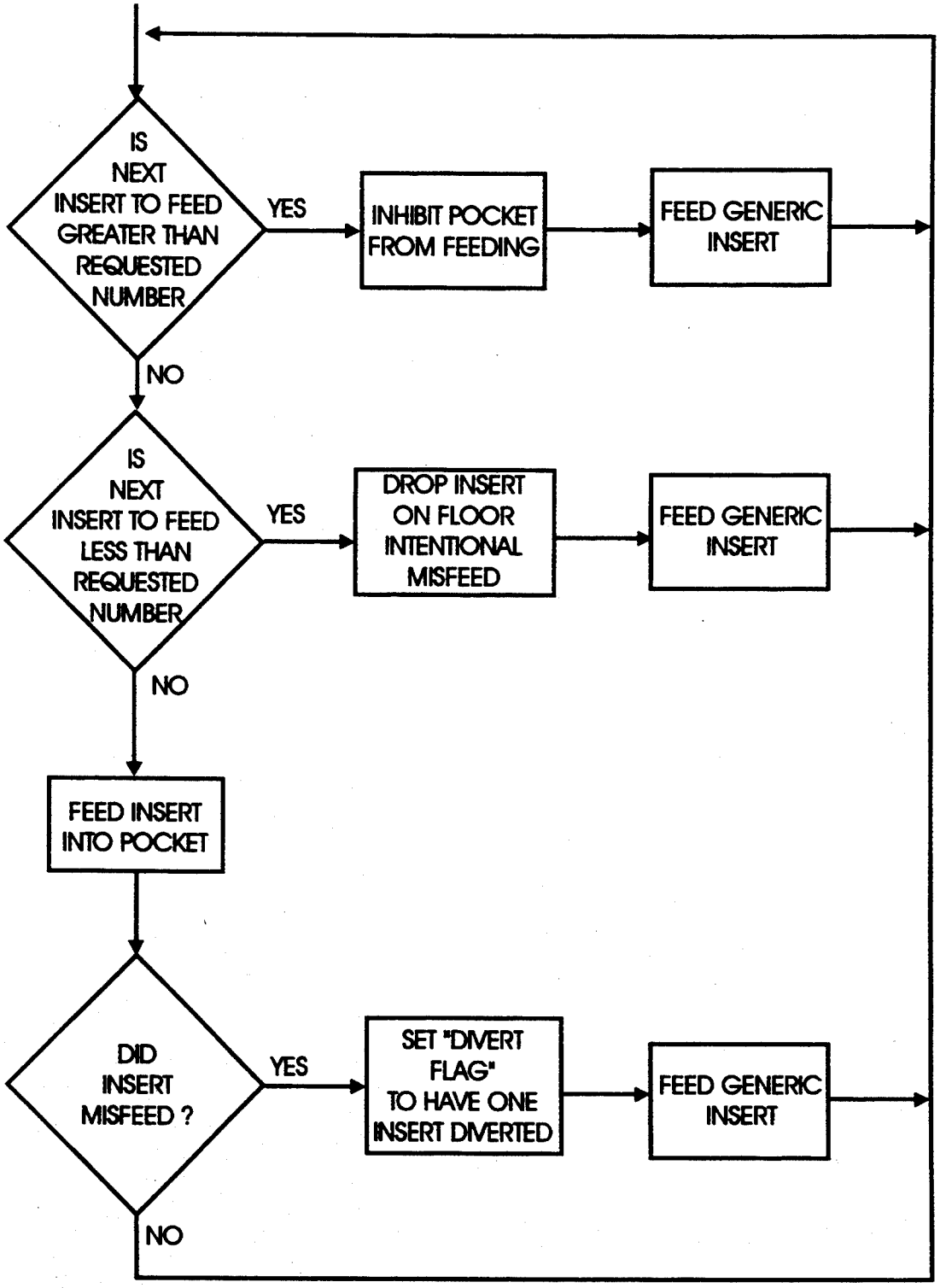
FIG. 15 is yet another flow chart dealing with yet another portion of FIG. 11 and is a detailed flow diagram of the pocket feed section of the insert feeder system.

The pocket feed section depicted in FIG. 15 controls the physical feeding of inserts into the bindery line pocket. This section also controls feeding of generic/non-personalized inserts in the case where the correct pre-personalized insert is not available for feeding. As a last comparison, this section compares the insert that is ready to be fed, by examining the FIFO buffer means of fed inserts created in the scan and divert section FIG. 14 to the next requested sequence number in the FIFO buffer means created by the bindery line control interface section FIG. 12. If the next to feed insert is a higher number than the requested sequence number, this section will not feed the insert to the next requested book, but instead will feed a generic insert in its place. If the next to feed insert is a lower number than the requested sequence number, this section will force the pocket to feed the insert but intentionally miss the book and allow the insert to land on the floor, this section will then feed a non-personalized generic insert to that book. Only if the requested sequence number matched the next to feed insert will this section allow the insert to feed into the pocket and consequently the book.

While in the foregoing specification a detailed description of the invention has been set down for the purpose of illustration and to comply with statutory requirements, many variations in the details hereingiven may be made by those skilled in the art without departing from the spirit and scope of the invention.

I claim:

1. In a method for selectively binding pre-personalized inserts into books in a binding line, comprising the steps of providing off line a batch of pre-personalized inserts, each insert having an indicia thereon that differs from the indicia on all of the other inserts in the batch, providing a binding line equipped with a binding control system and production database of indicia, said batch of indicia-equipped inserts corresponding in sequence to the sequence in which those indicia occur in said database, providing means for sequentially feeding said pre-personalized inserts from said batch to said binding line, providing means operatively associated with said feeding means for inhibiting said feeding means, for diverting inserts from said feeding means, and operating said binding line to form books while inserting a pre-personalized indicia-equipped insert into a book intended for that indicia.

2. The method of claim 1 in which said indicia is a name.

3. The method of claim 1 in which said steps include inserting other inserts into at least some of the books not receiving an indicia-equipped insert.

4. The method of claim 3 in which said steps include upon appearance of a malfunction, substituting a generic insert for a pre-personalized insert.

5. The method of claim 3 in which said step of providing a binding line includes providing a single pocket for each of said pre-personalized inserts and said generic inserts.

6. The method of claim 3 in which said step of providing a binding line includes providing a separate pocket for each of said pre-personalized inserts and said generic inserts.

7. The method of claim 3 in which the step of providing other inserts includes providing generic inserts.

8. In a method for selectively binding personalized inserts into books, comprising the steps of providing a brick of personalized inserts, providing a binding line equipped with a selective binding control system and production database, providing means for sequentially feeding personalized inserts from said brick to said binding line, providing means operatively associated with said feeding means for inhibiting said feeding means, for diverting inserts from said feeding means, for removing inserts from said feeding means and for introducing generic inserts into said binding line, operating said binding line to form books while inserting a personalized insert into a specific book according to said database except:

(a) if the currently sensed insert has an equal or lower number insert, then divert it;

(b) if a misfeed occurs, then divert one insert;

(c) if the next insert to feed has a higher number than that requested by the binding control system, then inhibit the feed of inserts;

(d) if the next insert to feed has a smaller number than that requested by the binding line control system, then removing the insert;

(e) if the personalized feed is inhibited, then feed a generic insert;

(f) if the sensed inset is a lower numbered insert than that requested by the binder line control system, then divert the insert; and (g) if the number for an insert requested by the binder line control system contains an alpha character, then inhibit the feed.

9. The method of claim 8 in which if the removing step includes dropping the insert on the floor, then feeding a generic insert.

10. The method of claim 8 in which if the removing step includes feeding the lower numbered insert into a book, then removing the book at the end of the binding line.

* * * * *